US006155270A

United States Patent [19]

Samiean

[11] Patent Number: 6,155,270

[45] Date of Patent: Dec. 5, 2000

[54] NAIL POLISH REMOVER BOTTLE/ APPLICATOR WITH MANICURE DEVICES AND KIT

[76] Inventor: Anita Samiean, P.O. Box 5475, Irvine, Calif. 92616

[21] Appl. No.: 09/366,264

[22] Filed: Aug. 2, 1999

[51] Int. Cl.[7] ..... A45D 29/18

[52] U.S. Cl. ..... 132/73; 132/75.4; 132/75.6; 132/75; 132/286

[58] Field of Search ..... 132/73, 73.5, 74.5, 132/75, 75.3, 75.4, 75.5, 75.6, 76.2, 76.4, 286, 317, 320; 401/18, 23, 34, 38, 122, 126, 198, 207; 206/581, 229, 459; D9/310, 307; D11/158, 157

[56] References Cited

U.S. PATENT DOCUMENTS

| | | | |
|---|---|---|---|
| D. 188,958 | 10/1960 | Damiani | D9/310 |
| D. 392,880 | 3/1998 | Fujimoto | D9/310 |
| 820,067 | 5/1906 | Richardson | 206/457 |
| 1,464,176 | 8/1923 | Freund | 206/229 |
| 2,014,822 | 9/1935 | Trachtenberg | 206/229 |
| 2,248,963 | 7/1941 | Copeman | 206/457 |
| 4,474,195 | 10/1984 | Warner | 132/73 |
| 4,964,372 | 10/1990 | Zeenni et al. | 132/74.5 |
| 5,577,851 | 11/1996 | Koptis | 401/207 |
| 5,846,011 | 12/1998 | Berstein et al. | 401/23 |
| 5,897,262 | 4/1999 | Bratby-Carey | 401/18 |

*Primary Examiner*—Pedro Philogene

[57] ABSTRACT

An improved nail polish remover bottle having a disposable nail polish remover applicator cap to remove the old nail polish is provided and consists of a body member designed as a dolphin. A cover cap to protect and seal the open end of the nail polish remover bottle and a nail polish remover applicator represent the snout which can be inserted to the body member. The dorsal fin represents a cuticle pusher with a sharp lined edge to push back the cuticles. The pectoral fins comprise a nail file to shape the nail edges and a buffer to smooth the nails. Two caudal fins, one featuring a finger nail cutter and the other a toe nail cutter can be optionally inserted to the tail of the dolphin. In conjunction with the invention a kit is arranged to accommodate all the above in addition to nail polish nail containers.

14 Claims, 8 Drawing Sheets

NAIL POLISH REMOVER BOTTLE/ APPLICATOR WITH MANICURE DEVICES AND KIT

FIELD OF THE INVENTION

The present invention relates to a new and improved cosmetic applicator bottle for nail care products. More particularly, this invention relates to a dolphin shaped nail polish remover bottle comprising a separable nail polish remover applicator cap, two buffers, a cuticle pusher, two nail files, a detachable finger nail cutter, and a detachable toe nail cutter. The necessity of having a Nail Polish Remover Bottle/Applicator with Manicure Devices and Kit is compounded by the fact that it is operated without the need to use separate devices when manicuring a nail. In using a nail polish remover product, a cotton ball is usually placed across the bottle mouth that must be slightly inverted to allow the cotton ball to absorb the polish remover liquid. The consumer must then balance the soaked cotton ball while closing the cap or may accidentally leave the bottle open, causing the solvent to evaporate with time. Usually application of the cotton ball to the open mouth of the bottle results in spillage. In addition, the transfer technique procedure is apparently burdensome and time consuming, thereby a need exists for an improved system in delivering nail polish remover to finger and toe nails that overcomes these disadvantages. Accordingly, this new invention satisfies a need for a mess-free application by allowing the dispensing and application of the nail polish remover onto the nail without the need to manually soak separate sponges or cotton swatches. Additionally, the present invention provides a dolphin shaped polish remover bottle which due to it's design can rest in the hand for one's convenient usage. The caring of nails is well known. Through the years the use of nail care products has continued to rise. This application, containing a uniquely combined nail care device having a detachable nail polish remover applicator cap is for the sake of convenience, and provides ease of use. Further, in accordance with the present invention there is provided a kit adapted for manicuring a nail. The kit also includes nail polish containers and two storage bags.

BACKGROUND OF THE INVENTION

Numerous cosmetic bottles which include bottle caps with sponge applicators attached thereto have been made. For example, U.S. Pat. Nos. 4,932,802, 4,998,838, 4,964,372, 4,474,195, 5,762,077, 4,476,883, 4,446,965, 5,065,778, 4,282,891, and 4,998,839 all have similar modes of use in that they allow dispensing and application of a cosmetic product directly onto a body part through the dispenser opening and onto an absorbent material to be wiped or rubbed across the particular area. While these devices may be suitable for the particular purpose they address, they would not be as suitable for the purposes of the present invention as heretofore described. In particular, there is no applicator bottle which also is capable of manicuring a nail.

U.S. Pat. No. 4,932,802 for Nail Polish Bottle Cover Having a Nail Polish Remover Dispenser, discloses a fixture for a nail polish remover bottle cover which includes a nail polish remover applicator affixed to the threaded neck of the body member.

U.S. Pat. No. 4,998,838 for Cover Make-Up Dispenser discloses a dispenser for application of cover make up which has an applicator sponge and a blender pad as a part thereof U.S. Pat. No. 4,964,372 for Finger Nail Treating Device discloses a container that upon squeezing will fill the liquid absorbing sponge having a finger receiving hole therein.

U.S. Pat. No. 4,474,195 for Nail Polish Removal Devices Having Supply Container discloses a supply container on which the treatment container with an absorbent member disposed therein can be carried.

U.S. Pat. No. 5,762,077 for Apparatus for Manicuring Nails discloses a combination of a polish applicator and a solvent applicator for removal of the nail polish from a finger nail.

U.S. Pat. No. 4,476,883 for Container Assembly discloses a container assembly specifically structured for placement of all the fingers in various recesses to apply a predetermined liquid or solution to the fingernails of a person.

U.S. Pat. No. 4,446,965 for Liquid Applicator discloses a container with slit foam sponge to accept the insertion of one finger tip for application of the liquid.

U.S. Pat. No. 5,065,778 for Finger Nail Polish Removing Device discloses a liquid chamber in the base with finger nail bore openings as part of the finger nail scrubbing structure mounted within the container.

U.S. Pat. No. 4,282,891 for Finger Nail Treating Device discloses a cylindrical container provided with a sponge having a finger hole, therein.

U. S. Pat. No. 4,998,839 for Applicator for Nail Polish Remover discloses two chambers allowing the disposal of soiled absorbent material within the applicator.

SUMMARY OF THE INVENTION

A primary object of the present invention is to provide an improved nail polish remover bottle having a disposable nail polish remover applicator presenting a sponge press-fitted into the confined dimensions of the applicator cap.

Another object is to provide an improved nail polish remover bottle inclusively having a cuticle pusher, two buffers, two nail files, a detachable finger nail cutter, and a detachable toe nail cutter.

An additional object is to provide a kit furnished with an outer zipper in accordance with the present invention which is convenient and complete for use in different environments.

A further object of the kit is having two storage bags provided with zippers for nail care assembly, it's transportation and by having indentations in the casing to allow fitting of the nail polish remover bottle and nail polish applicators into same.

A still further object is the shape of the bottle as a dolphin to rest in the hand and device does provide support cushioning means that permit pressing of the absorbent material against the user's nail to release the nail polish remover.

Other objects, features and advantages will be apparent in the following detailed description of the preferred embodiments taken in conjunction with the accompanying drawings in which:

DETAILED DESCRIPTION OF THE PREFERRED EMBODIMENTS

Figure 1:
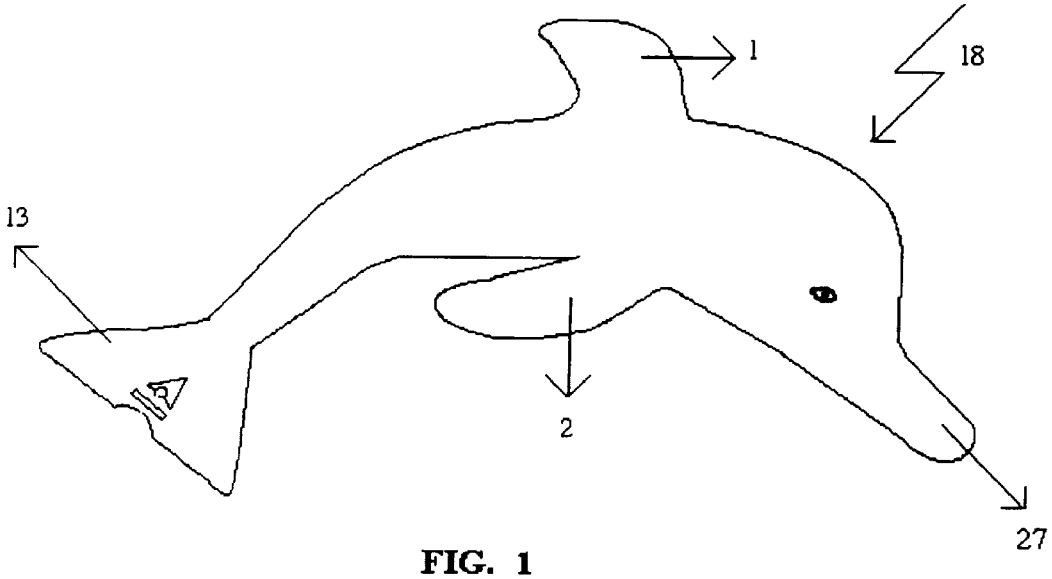
FIG. 1 is a two dimensional plan, side view of the preferred embodiment of the concealed bottle cap, the cuticle pusher, one buffer, and the detachable finger nail cutter.
Figure 2:
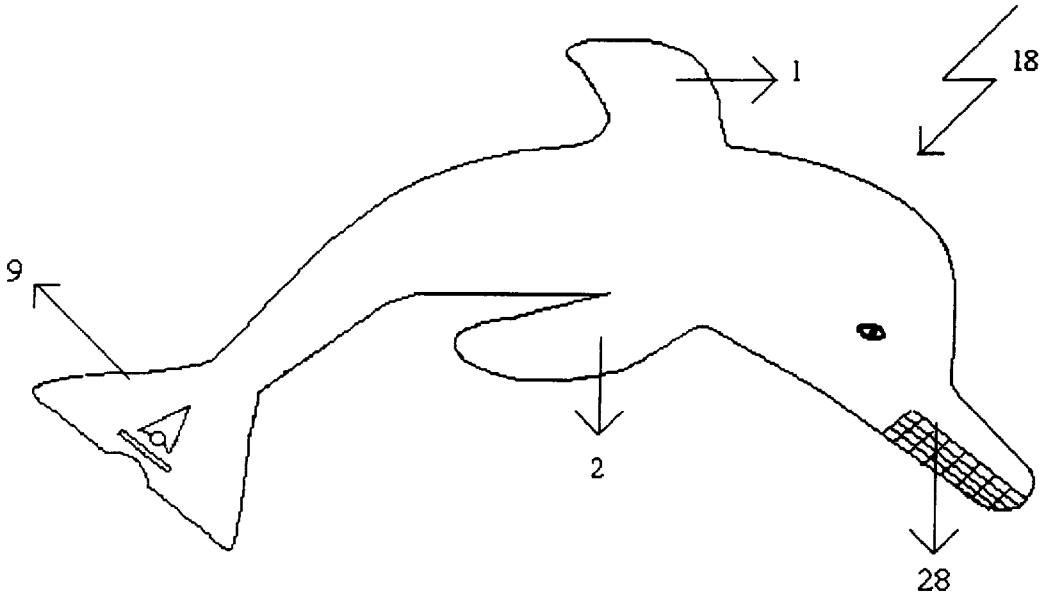
FIG. 2 is a two dimensional plan, side view thereof, with a detachable toe nail cutter, and the snout sponge applicator cap mounted onto the head of the dolphin.
Figure 3:
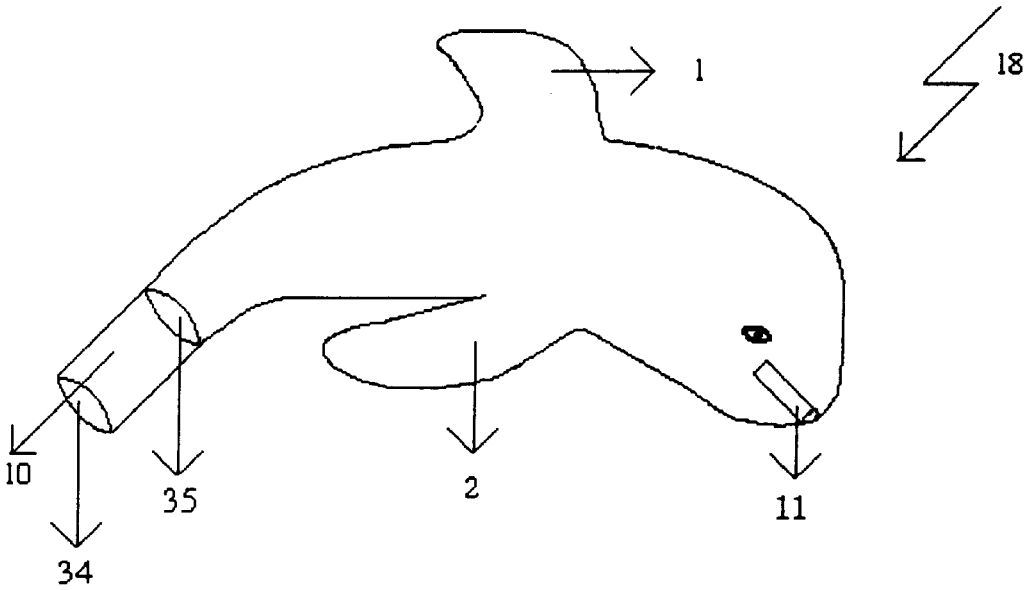
FIG. 3 is the same view as FIGS. 1 and 2 with the cap and nail cutter means removed from the body of the bottle.

Turning now descriptively to the drawings, FIGS. 1 through 3 illustrate an improved nail polish remover bottle 18. The essential components of the dolphin shaped nail polish remover bottle 18 are a cover cap 27, a removable sponge applicator cap 28, a cuticle pusher 1 on the dorsal fin, a buffer 2 and a nail file on each pectoral fin, a finger nail cutter 13 on one caudal fin, and a toe nail cutter 9 on another caudal fin. The individual components are described in detail in the following paragraphs.

The nail polish remover bottle 18 is preferably molded of materials that are durable and lightweight such as plastic resin or the like. With reference to FIG. 3, an elongated annular recess 11 inside of the wall of the body member 18 is provided through which the contents are dispensed and is attached to the open end of the dolphin to provide means by which to securely insert the cover cap 27 and the sponge applicator cap 28 to the bottle 18.

FIGS. 5A, 5B, 5C, and 9 show the snout shaped sponge applicator cap 28 comprised of an elongated annular plastic ridge 29 extending away from the main body 8 to snap-fit inside of the annular recess 11 of the open end of the dolphin bottle 18. A small opening 37 fitted on the tip of the ridge 29 is provided for controlling the amount of solvent delivered to the applicator sponge 7 for better usage. The application sponge 7 is adhesively affixed to the bottom of the snout shaped body 8 and is dimensioned to fit within the confined form of it, for ease of use. The sponge applicator 7 is made of an elastic porous absorbent material through which the solvent is directly dispersed. The sponge applicator cap 28 features a retainer 30 means to hold the applicator sponge 7 securely in position.

Figure 4A:
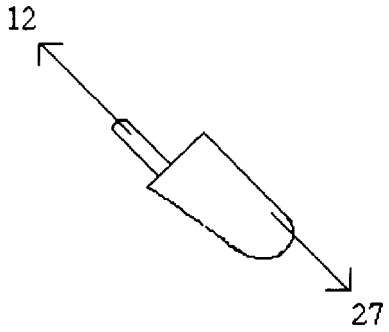
FIG. 4A is an angular side plan view of the sealing cap in accordance with the invention.
Figure 4B:
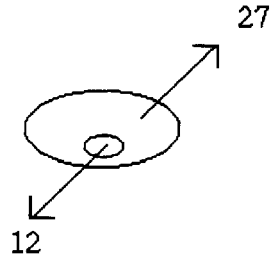
FIG. 4B is a bottom plan view, thereof.
Figure 5A:
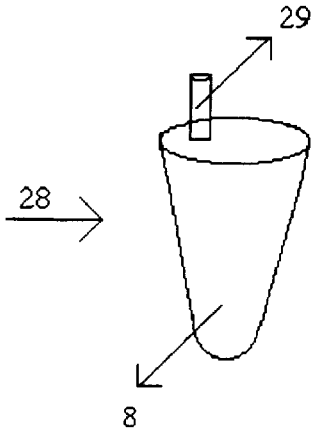
FIG. 5A is a top perspective view of the snout sponge applicator cap.
Figure 5B:
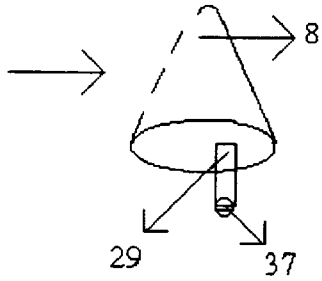
FIG. 5B is a side view, partially in cross section, thereof
Figure 5C:
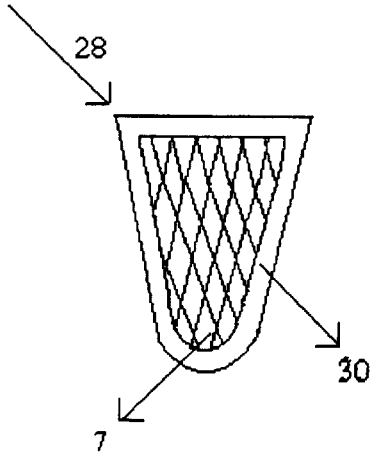
FIG. 5C is a bottom undercarriaged perspective view of the snout sponge applicator cap representing the sponge.

Referring to FIGS. 4A and 4B, a cover cap 27 is provided to seal and protect the bottle 18 during periods of non-use, which can also be snap-fit attached to the bottle 18. The cover cap 27 is rigid and snout-shaped attached to a plastic ridge 12 dimensioned to fit inside of the open end of the dolphin bottle 18. The long narrow recess 11 within the body member 18 can accommodate the plastic ridge 12 that extend along the snout shaped cover cap 27. The cover cap 27 is preferably constructed of a durable lightweight material which is similar to the rest as described above.

Figure 6:
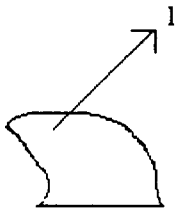
FIG. 6 is a side view of the cuticle pusher.

As can be seen in FIG. 6, the cuticle pusher 1 is presented as the dorsal fin extending away from the body member 18. The cuticle pusher 1 is preferably constructed of a metal material or the like to gently push back the cuticles.

Figure 7A:
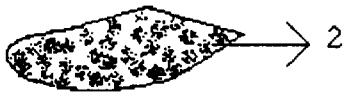
FIG. 7A is a top perspective view of the pectoral fin featuring a buffer.
Figure 7B:
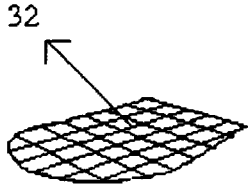
FIG. 7B is a bottom perspective undercarriaged view of the pectoral fin showing a nail file.

Referring now to FIGS. 7A and 7B, a nail file 32 and a buffer 2 are mounted on each pectoral fin. In particular, the bottom part of each pectoral fin features a nail file 32 that attaches thereto. The top part of each pectoral fin is a buffer 2 which is fixedly adhered to the flat surface of the nail file 32 below. The nail file 32 can enable the consumer to file and shape while the buffer 2 can provide nail smoothness to help keep the manicure looking better longer. In general, the pectoral fin may be shaped in any other configuration that would provide comfort as may be apparent to those of skill in the art.

Figure 8:
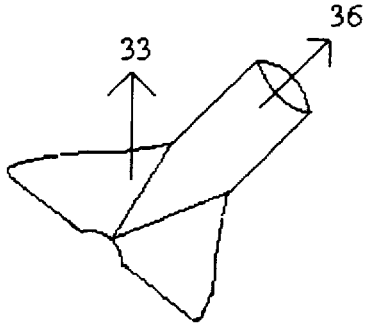
FIG. 8 is a top perspective view of the caudal fin of the dolphin.
Figure 8A:
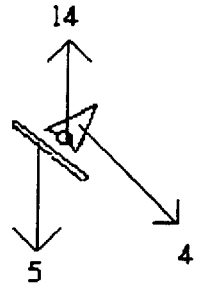
FIG. 8A is a top plan view of the toe nail cutter.
Figure 8B:
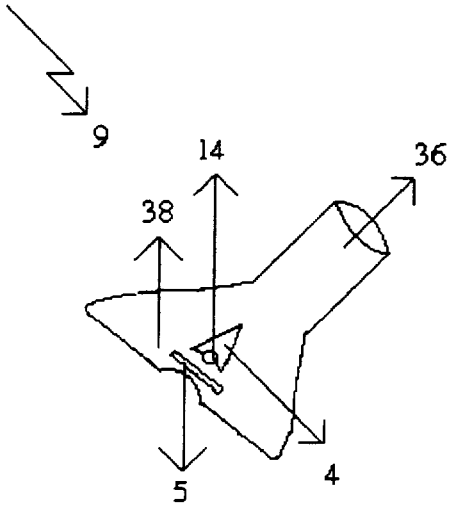
FIG. 8B is a top perspective view of the toenail cutter on the caudal fin.

With reference to FIGS. 8A and 8B, there is shown a toe nail cutter 9 that sits on the end of one of the caudal fins. The toe nail cutter 9 which is normally bigger than a finger nail cutter features a base piece 38, an edge cutter 5, a hinge 14, and a thumb lever 4. The ridge 36 on the caudal fin is provided for inserting and attaching purposes.

Figure 8C:
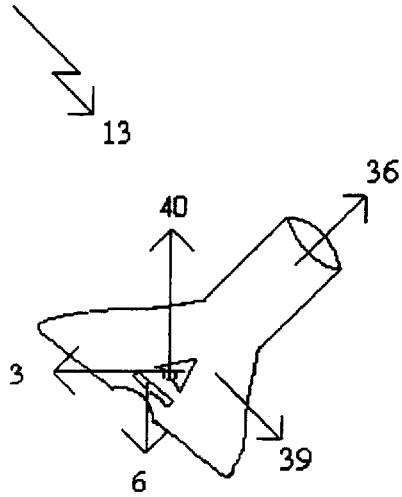
FIG. 8C is a top perspective view of the fingernail cutter on the caudal fin.
Figure 8D:
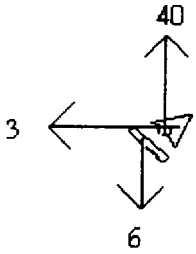
FIG. 8D is a top plan view of the finger nail cutter.
Figure 9:
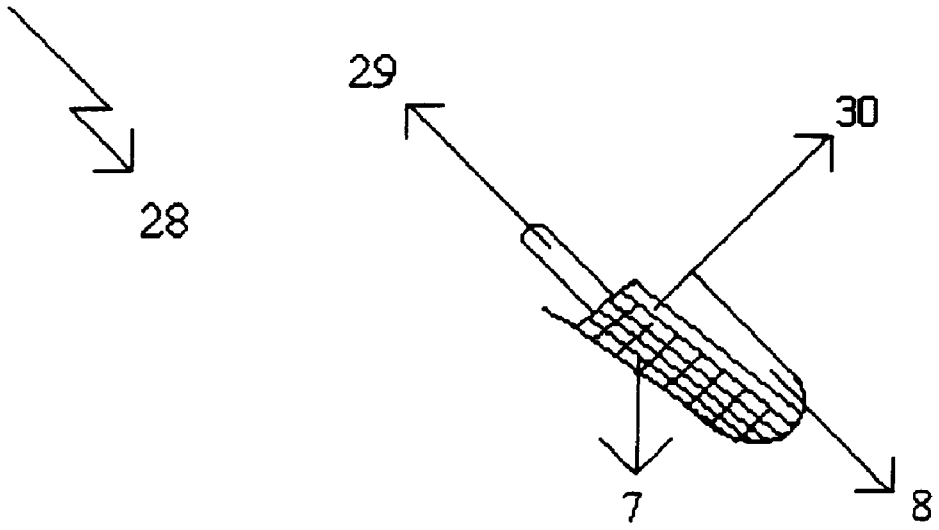
FIG. 9 is an angular side perspective view of a snout sponge applicator cap.

Referring now to FIGS. 8C and 8D, the finger nail cutter 13 which is mounted on the end of another caudal fin features a base piece 39, an edge cutter 6, a hinge 40, and a thumb lever 3. Accordingly, the ridge 36 does the same as described above. The nail cutters are preferably constructed of a hard metal or the like.

As can be observed in FIG. 8, there is one other removable plain caudal fin 33 with a ridge 36 which is molded from durable and lightweight plastic similar to the body member provided for decorating purposes when nail cutters are not in use.

Referring again to FIG. 3, the three caudal fins are removably mountable to the tail 10 of the dolphin. The tail 10 is a wide hollow elongated chamber. The tail 10 has a closed top 35 and an open bottom 34 ends allowing it to accommodate the considerably wide elongated ridge 36 of the three caudal fins by inserting therein. The closed top 35 end of the tail 10 serves to provide a stable base that allows the polish remover to stay within the body member 18 and prevent spillage. As a result of this assembly the caudal fins can be attached to the closed end 35 of the dolphin so that the detachment of the caudal fins are prevented by means of a perimetric edge of the tail 10 and another perimetric edge of the ridges 36 on the caudal fins. Other engagement means known to those skilled in the art is to attach the three caudal fin members so they may also be used, provided that a tight seal between the tail 10 of the dolphin and ridges 36 on the caudal fins is formed. The caudal fins may then be easily removed.

Figure 10:
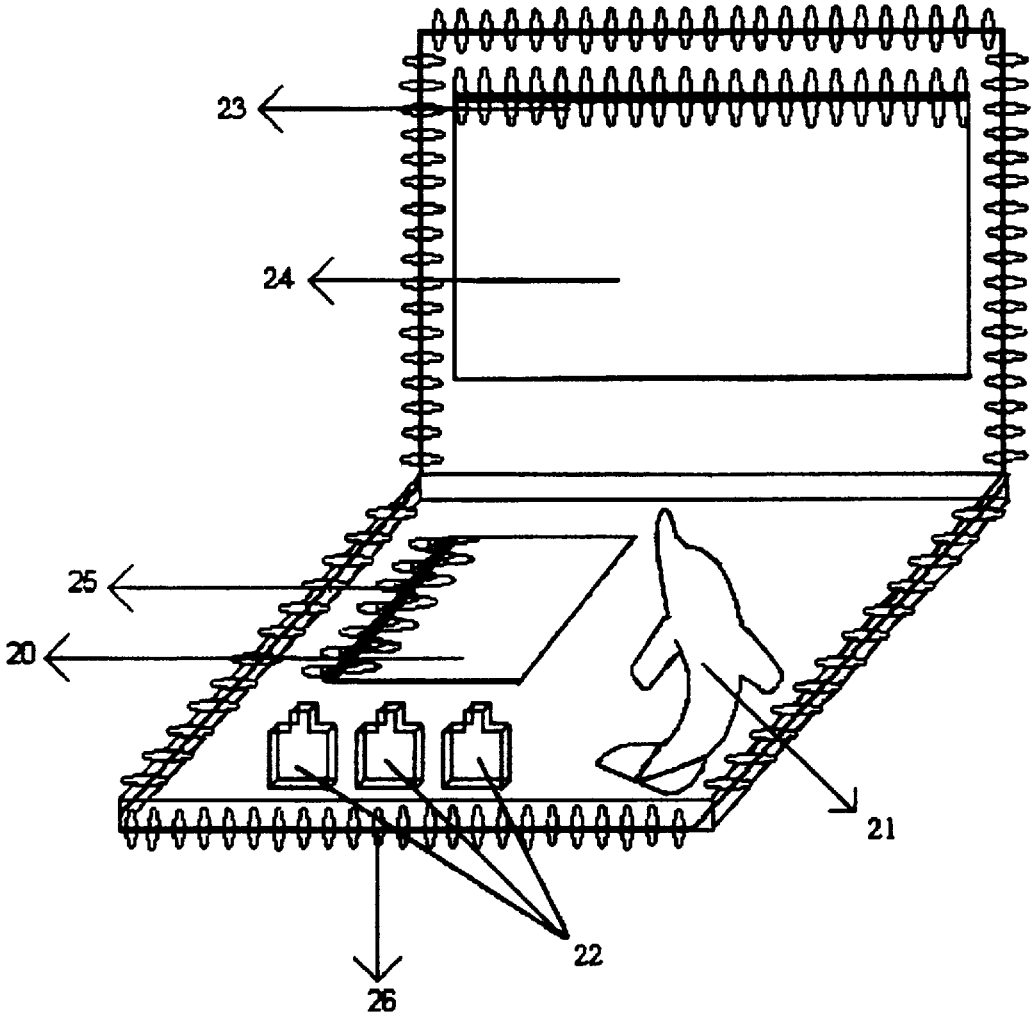
FIG. 10 is a geometric perspective view of the kit with the indentations to accommodate the present invention and nail polish containers.

With reference to FIG. 10, device 18 may be used in a kit adapted to provide a complete manicure for a nail. The kit has a perimeter zipper 26 to provide means by which to bring the parts together and apart. The kit is preferably constructed of plastic material or the like which will include indentations and two small storage bags. There is a dolphin shaped indentation 21 in the casing that allow for the present device 18 to fit in and an additional three indentations for the nail polish applicators 22. The kit contains two different size bags, provided that the bag 24 on the top part having a bigger space than the bag 20 on the bottom. The kit is also provided with one zipper 23 for the top storage bag 24 and another zipper 25 for the bottom storage bag 20, where the different designed cosmetic products and parts can be stored for transportation.

The foregoing descriptions of specific embodiments of the present invention have been presented for purposes of illustration and description. It should be understood that they are not intended as a definition of the limits of set present invention and in light thereof various modification will be suggested to one skilled in the art, all of which are within the spirit and purview of this invention.

What is claimed is:

1. A device for storing liquid comprising:

a. a bottle including a sidewall, a chamber, and an open end, said bottle further including a cuticle pusher extending away from said sidewall; and b. two nail cutters detachably attached to said bottle.

2. A device of claim 1, further comprising a sponge applicator cap constructed for closing said open end of said bottle, said sponge applicator cap including a sponge for absorbing liquid stored in said bottle and a main body attached to a projecting ridge.

3. A device of claim 2, further comprising a means for affixing said sponge applicator cap to said open end of said bottle such that a portion of said sponge applicator cap projects into said bottle and out of said bottle.

4. The device of claim 3, further comprising a nail file and buffer both attached to said bottle.

5. The device of claim 1, wherein one of said nail cutters is a fingernail cutter and one of said nail cutter is a toe nail cutter.

6. The device of claim 4, wherein said device is shaped as a dolphin to rest in the hand to provide support cushioning means for the convenient application of liquid inclusively having manicure devices attached thereto.

7. The device of claim 6, wherein said bottle is shaped like a dolphin including a snout, a dorsal fin, two pectoral fins, and two caudal fins; said sponge applicator cap forming said snout said nail file and buffer forming said pectoral fins, and said nail cutters forming said caudal fins.

8. A kit adapted for storing products within and for removing products from within to provide a complete manicure for a nail, comprising:

a. a device for storing liquid comprising:

i. a bottle including a sidewall, a chamber, and an open end, said bottle further including a cuticle pusher extending away from said sidewall to push back the cuticles; and ii. two nail cutters detachably attached to said bottle;

b. indentations shaped to accommodate said bottle and nail polish containers for application of nail polish to the nail; and c. bags for transportation and storage of different designed products and parts.

9. A kit of claim 8, further comprising a sponge applicator cap constructed for closing said open end of said bottle, said sponge applicator cap including a sponge for absorbing liquid stored in said bottle and a main body attached to a projecting ridge.

10. A kit of claim 9, further comprising a means inside of said open end of said bottle for affixing said sponge applicator cap to said open end of said bottle such that a portion of said sponge applicator cap projects in to said bottle and out of said bottle.

11. A kit of claim 10, further comprising a nail file and buffer both attached to said bottle.

12. A kit of claim 8, wherein one of said nail cutters is a fingernail cutter and one of said nail cutter is a toe nail cutter.

13. A kit of claim 8, wherein said device is shaped as a dolphin to rest in the hand to provide support cushioning means for the convenient application of liquid inclusively having manicure devices attached thereto.

14. A kit of claim 13, wherein said bottle is shaped like a dolphin including a snout, a dorsal fin, two pectoral fins, and two caudal fins; said sponge applicator cap forming said snout, said nail file and said buffer forming said pectoral fins, and said nail cutters forming said caudal fins.

* * * * *